US006609263B2

(12) United States Patent
Burns

(10) Patent No.: US 6,609,263 B2
(45) Date of Patent: Aug. 26, 2003

(54) MENDING TOOL

(76) Inventor: Lee Burns, 8923 S. Marshfield, Chicago, IL (US) 60620

( * ) Notice: Subject to any disclaimer, the term of this patent is extended or adjusted under 35 U.S.C. 154(b) by 145 days.

(21) Appl. No.: 09/879,291

(22) Filed: Jun. 12, 2001

(65) Prior Publication Data

US 2002/0092099 A1 Jul. 18, 2002

Related U.S. Application Data

(63) Continuation-in-part of application No. 09/187,416, filed on Nov. 6, 1998, now abandoned.

(51) Int. Cl.[7] ..... B25F 1/00
(52) U.S. Cl. ..... 7/170
(58) Field of Search ..... 7/170; 30/169, 30/294

(56) References Cited

U.S. PATENT DOCUMENTS 690,116 A * 12/1901 Muller ..... 30/169
2,705,833 A * 4/1955 Grantz ..... 30/294
4,722,129 A * 2/1988 Keller ..... 29/267

* cited by examiner

*Primary Examiner*—Joseph J. Hail, III
*Assistant Examiner*—David B. Thomas
(74) *Attorney, Agent, or Firm*—Tracey R. Thomas

(57) ABSTRACT

A mending tool (10) for drywall and plaster surfaces has a gouger (14). The gouger (14) has a member which is securely connected at a rear end to a handle front (12F). The gouger (14) has a gouger tip (14B) which is positioned at a front distal end of the member. The gouger tip (14B) has a gouger tip point (14BA) at a distal end and a gouger tip notch (14BB) positioned adjacent thereto. The gouger tip point (14BA) functions to extract and remove material from a surface. The gouger tip notch (14BB) functions to prevent attachment of the removed material to the gouger tip point (14BA).

2 Claims, 2 Drawing Sheets

MENDING TOOL

This is a continuation-in-part of Ser. No. 09/187,416 filed Nov. 6, 1998, abandoned

BACKGROUND OF THE INVENTION

1. Field of the Invention

The present invention relates to tools. More particularly, the present invention relates to a tool used in mending surfaces such as a drywall or plaster.

2. Description of the Prior Art

Over time surfaces such as drywall or plaster may be damaged by objects striking the surface thereby creating cracks in the surface. The common method of dealing with this problem, especially with respect to drywall cracks, is to apply a mending compound such as spackling compound over the area and to sand the area Many times, hairline and other small cracks are difficult to totally eliminate. What is needed is a device that can assist in making hairline and other small cracks imperceptible.

Numerous innovations for drywall and other mending tools have been provided in the prior art that are described as follows. Even though these innovations may be suitable for the specific individual purposes to which they address, they differ from the present invention as hereinafter contrasted.

In U.S. Pat. No. 5,638,570, titled Drywall Bullnose Cleaner Tool, invented by Glen A. Gruner, a tool is described for scraping material from a bullnose installed on a corner joint of a drywall installation including an elongated device having a handle portion, a first end portion, a second end portion, and is sized to be held in one hand. The first end portion has a first convexly shaped edge that matches a concavely shaped portion of the bullnose. It enables a user to scrape the material from the bullnose by moving the convexly shaped edge along the concavely shaped portion of the bullnose. Preferably, the first concavely shaped edge is shaped in a 75-degree arc having a 0.875 inch radius to match a convexly shaped portion of the bullnose when the bullnose is installed on a 90-degree corner joint, and the second end portion of the elongated device includes a second convexly shaped edge that is shaped in a 50-degree arc having a 1.125 inch radius to match the concavely shaped portion of the bullnose when the bullnose is installed on a 135-degree corner joint. One embodiment takes the form of a 6.5 inch long aluminum bar having the specified shape.

The patented invention differs from the present invention because the patented invention is a tool for scraping material from a bullnose corner joint. The patented invention lacks a handle, and a broadheaded shovel shaped curved tool end.

In U.S. Pat. No. 5,338,128, titled Drywall Joint Finishing Tool, invented by Angel Blanco, an apparatus is described for adapting a drywall skim box to an extension pole to permit application of finishing compound to joints in locations remote from the user, such as in extended or high walls. The apparatus includes a curved arm, one end of which is coupled to an extension pole and the other end of which includes a mounting platform for attachment to a skim box. The skim box is both rotatably and pivotally coupled to the arm for proper positing on a wall surface to be finished. The geometrical relationship between the position of the skim box, the arm, and the extension pole results in application of sufficient pressure to properly operate the skim box as it is moved along a joint.

The patented invention differs from the present invention because the patented invention is a tool for applying joint compound to drywall. The tool is a skim box which is positioned on the end of an extension enabling the user to reach joints that would otherwise require a ladder. The tool is curved to adapt to the angle of the user with respect to the wall. The skim box dispenses joint compound as the user moves the tool along a joint. The present invention lacks the feature of dispensing joint compound, and is not adapted for use remotely from the user. The patented invention lacks a broadheaded shovel shaped curved tool end.

In U.S. Pat. No. 4,946,360, titled Finishing Tool, invented by John Brown, a finishing tool is described which provides a smooth finish to taped coved joints or to corner joints having an angle greater than 90 degrees as defined by converging wall board surfaces. The finishing tool includes a working plate and a supporting plate, each being provided with a substantially straight edge disposed transversely to the longitudinal axes of the tool. Each of the working and supporting plates is formed of resilient material to provide longitudinal and latitudinal flexural movement so as to allow the entire length of the straight edge of the working plate to engage seam sealing material applied to the corner joint and the adjacent wall board surfaces to provide a smooth continuous finish to the corner joint.

The patented invention differs from the present invention because the patented invention is a tool to apply joint compound to taped coved joints or to corner joints. The patented invention has two plates which are joined together and are made from a resilient material permitting the tool to bend. The two plates are attached to a handle. The present invention has an elongated member which is securely attached at one distal end to a handle. A tool member is securely attached at one end to an opposite end of the elongated member at an obtuse angle, the opposite end of the tool member forming a broadheaded shovel shaped curved tool.

In U.S. Pat. No. 4,713,886, titled Piercing Tool, invented by Takashi Ikeda, a device for locating an object concealed behind a pierceable member which is less dense than the object comprises a handle with a thin elongated needle mounted on the handle. The location of a denser object concealed behind the pierceable member, such as a stud located behind drywall, is indicated by driving the needle through the drywall at selected points until a stud is struck. The locating device preferably includes a collar member surrounding and embracing the piercing end of the needle which provides lateral support for this part of the needle. The collar telescopes within a bore provided on the handle during penetration of the pierceable member, with the collar being biased outboard relative to the bore to assure such lateral support at the point of needle penetration. A rigid sleeve surrounds a shank portion of the needle, with the collar member sliding along the outside of the sleeve during penetration. The sleeve lends further lateral support to the needle. The lateral support so provided enables the use of a very thin needle which readily penetrates the drywall and leaves only a tiny pin hole to repair, if necessary.

The patented invention differs from the present invention because the patented invention is a device for locating an object concealed behind a pierceable member. The patented invention lacks features similar to the present invention.

Numerous innovations for dry wall tools and other mending tools have been provided in the prior art. Even though these innovations may be suitable for the specific individual purposes to which they address, they would not be suitable for the purposes of the present invention as heretofore described.

SUMMARY OF THE INVENTION

The present invention has a handle. An elongated member is securely attached at one distal end to the handle. A tool member is securely attached at one end to an opposite end of the elongated member at an obtuse angle. The opposite end of the tool member is formed into a broadheaded shovel shaped curved tool.

The types of problems encountered in the prior art are hairline and other small cracks in drywall, plaster or other similar surfaces that must be made imperceptible for aesthetic reasons. Hair-line and other small cracks in drywall or plaster surfaces are typically the most difficult to eliminate.

The tool is used to make a division in the surface at the location of the crack. The division can be up to a quarter of an inch wide depending on the pressure applied. The tool easily follows the contour of the crack and extracts drywall or plaster material, creating a slightly widened crack which can be more easily filled with a drywall or surface-mending compound. The surface can then be sanded to restore smoothness. Even the smallest hair-line cracks can be totally eliminated and made imperceptible using the present invention. In the prior art, unsuccessful attempts to solve this problem were attempted namely: using large amounts of drywall compound or other mending compounds, followed by aggressive sanding. However, the problem was solved by the present invention because a V-shaped cutter is provided to make a narrow but, sufficiently deep gouge which is easily filled and sanded to eliminate cracks. Essentially, the tool makes a larger crack which can be more readily filled and subsequently sanded to make cracks imperceptible.

The present invention went contrary to the teaching of the art by increasing the width of the crack and then filling and sanding the cracks, rather than simply applying compound and sanding.

The present invention solved a long felt need for a tool which smooths wall cracks.

A synergistic effect was produced utilizing the present invention due to the following facts and results from experimentation: the cracks are more easily removed and made more imperceptible.

Accordingly, it is an object of the present invention to provide a clean, smooth surface where a crack once existed.

In keeping with these objects, and with others which will become apparent hereinafter, one feature of the present invention resides, briefly stated, in a gouger.

In accordance with another feature of the present invention, the gouger has a gouger tip which is inserted on or near a surface crack.

Another feature of the present invention is that the gouger tip has a gouger tip point which is used to extract material.

Yet another feature of the present invention is that the gouger tip has a gouger tip notch. This facilitates the extraction of material by providing space for the displaced material.

Yet another feature of the present invention is a sanding disk which resides on one end of the handle.

Still another feature of the present invention is that a handle is securely attached to the gouger to provide a secure gripping area for the user.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—mending tool (10)
12—handle (12)
12F—handle front (12F)
12R—handle rear(12R)
12A—handle body (12A)
14—gouger (14)
14A—gouger first member (14A)
14B—gouger tip (14B)
14BA—gouger tip point (14BA)
14BB—gouger tip notch (14BB)
14C—gouger second member (14C)
14D—sanding disk (14D)
16A—gouger first member (16A)
16B—gouger tip (16B)
16C—gouger second member (16C)
16BA—gouger tip point (16BA)
16BB—gouger tip notch (16BB)
16D—sanding disk (16D)

DESCRIPTION OF THE PREFERRED EMBODIMENT

Figure 1:
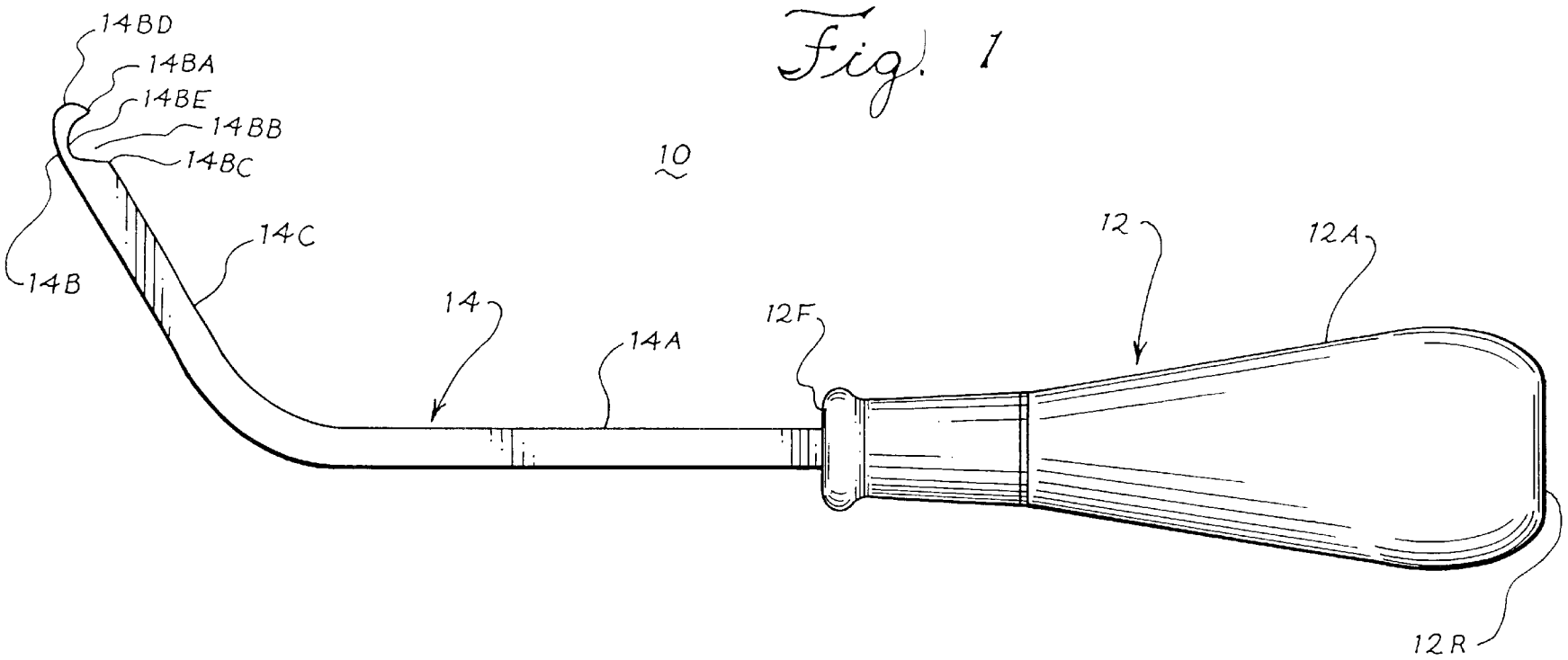
FIG. 1 is a side view of a mending tool.

Now referring to FIG. 1 which is a side view of a mending tool (10). The tool (10) further comprises a gouger (14) having a member which is securely connected at a rear end to a handle front (12F). The handle (12) has a handle rear (12R), on which a sanding disk (14D) may reside. The (14) comprises a gouger tip, (14B) which is positioned at a front distal end of the member. The gouger tip (14B) comprises a gouger tip point (14BA) at a distal end and a gouger tip notch (14BB) positioned adjacent thereto. The gouger tip point (14BA) functions to extract and remove material from a drywall or plaster surface. It should be understood that while the tool is described as applying to drywall or plaster in the preferred embodiment, the tool can be applied to any surface that can be penetrated by the gouger tip (14B). The gouger tip notch (14BB) allows the removed material to be the gouger tip point (14BA).

The gouger (14) member further comprises a gouger first member (14A) securely attached at a rear end to a handle front (12F) and a gouger second member (14C) securely attached at a rear end to a front distal end of the gouger first member (14A). The gouger first member (14A) is configured substantially parallel to a longitudinal axis of the handle (12). The gouger second member (14C) is configured at an obtuse angle to the gouger first member (14A) which functions to facilitate positioning of the gouger tip point (14BA) near or on a crack in drywall or plaster.

Figure 2:
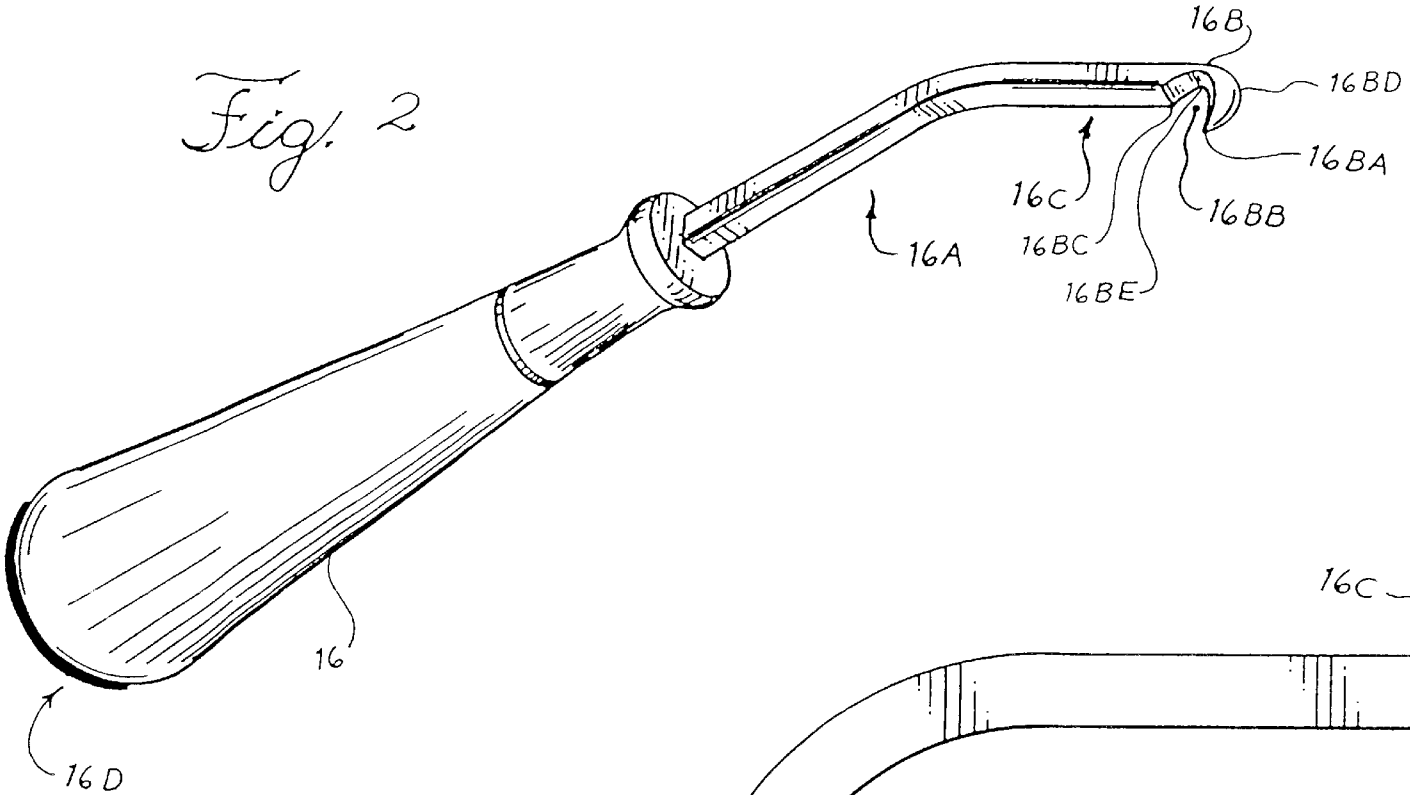
FIG. 2 is an alternative embodiment of the mending tool.
Figure 3:
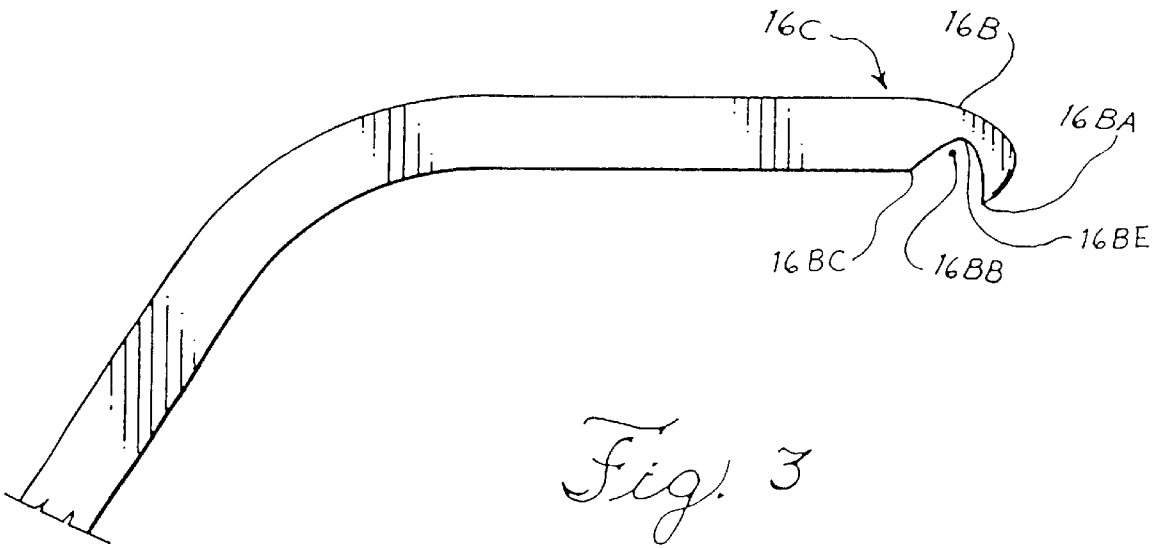
FIG. 3 is side view of the alternative embodiment in FIG. 2.

Referring to FIGS. 1, 2 and 3, the gouger tip (14B)(16B) has a circumference that varies continuously at each adjacent point beginning at the section (14BC)(16BC) of the gouger tip notch (14BB) (16BB) closest to the handle (12)(16) and ending at the gouger tip point (14BA)(16BA). The continuation circumference variation accounts for the unique broad shovel shape of the gouger tip (14B) (16B) and the shape of the gouger tip notch (14BA)(16BA). The circumference of the gouger tip (14B) (16B) becomes smaller when moving from the section (14BC)(16BC) of the gouger tip notch (14BB) (16BB) closest to the handle (12)(16) toward the center point (14BE)(16BE) and becomes larger past the center point (14BE)(16BE), thereby giving the gouger tip (14B)(16B) its broad head and shovel shape, and thereafter becoming smaller when moving toward the gouger tip point (14BA)(16BA). The gouger tip point (14BA)(16BA) being a sharp point suitable for penetrating drywall and plaster surfaces. Preferably, the gouger tip (14B)(16B), when inserted at a crack in a surface to make a larger division, creates a V-shaped, triangular opening that is 3/16 inch to ¼ inch deep and no more than ¼ inch wide. At these approximate dimensions, cracks in drywall or plaster can be more readily and filled with compound and sanded to make cracks imperceptible after painting. It is the broad head and shovel shape of the gouger tip (14B)(16B) that creates the V-shaped opening, along with the shape of the gouger tip notch (14BB) (16BB). The gouger tip notch (14BB)(16BB) also facilitates the displacement of surface material.

When pressure is applied, the gouger tip point (14BA) first penetrates the cracked area at one end of the crack. Being controlled by a user, a substantial portion of the gouger tip (14B) penetrates the drywall or plaster and follows along the crack, gouging and displacing material through to the other end of the crack. The widened crack is filled with a mending compound, such as drywall or spackling compound, and sanded to eliminate the crack.

The tool (10) may be is constructed from a material selected from a group consisting of wood, wood composite, metal, metal alloy, fiberglass, epoxy, carbon-graphite, plastic, and plastic composite.

It will be understood that each of the elements described above, or two or more together, may also find a useful application in other types of constructions differing from the type described above.

While the invention has been illustrated and described as embodied in a mending tool for drywall and plaster surfaces, it is not intended to be limited to the details shown or the applications described since it will be understood that various omissions, modifications, substitutions and changes in the forms and details of the device illustrated and in its operation can be made by those skilled in the art without departing in any way from the spirit of the present invention.

For example, FIG. 2 is an alternative embodiment of the tool of the present invention having a slightly different curvature between the gouger first member (16A) and the gouger second member (16C), as compared to the more pronounced curvature between the corresponding elements, gouger first member 14A and gouger second member 14C, in FIG. 1. The difference in curvature may result in improved user ergonomics and improved leverage for the user when applying pressure to a surface with the tool depending on several factors including, but not limited to: the location of the crack, the user's height and strength, and the relative hardness of the surface.

Also, the gouger tip (16B), gouger tip point (16BA) and gouger tip notch (16BB) have a slightly different shape but serve the same functions as the corresponding elements shown in FIG. 1. The tool of FIG. 2 also includes a sanding disk (16D) to sand down a surface after a compound has been applied. FIG. 3 is a side view of the gouger portion of the embodiment shown in FIG. 2, showing the gouger second member (16C), gouger tip (16B), gouger tip point (16BA) and gouger tip notch (16BB).

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected is set forth in the appended claims.

What is claimed is:

1. A tool (10) comprising:

a handle (12) which comprises a handle front (12F), a handle rear (12R) and a handle body (12A); and a gouger (14A) having a member securely connected at a rear end to a handle front (12F), the gouger (14) having a gouger tip (14B) positioned at a front distal end of the member, the gouger tip (14B) having a gouger tip point (14BA) functioning to prevent attachment of the removed material to the gouger tip (14BA), the gouger tip (14B) having a circumference that varies continuously at each adjacent point beginning at the section of said gouger tip notch (14BB) closest to said handle (12) and ending at said gouger tip point (14BA), said circumference of said gouger tip (14B) becoming smaller when moving from the section (14BC) of said gouger tip notch (14BB) closest to said handle (12) toward the center point of said gouger tip notch (14BB) and becoming larger to form a broad head past said center point, and thereafter smaller when moving toward said gouger tip point (14BA).

2. A tool (10) comprising:

a handle (12) which comprises a handle front (12F), a handle rear (12R) and a handle body (12A); and a gouger (14) having a member securely connected at a rear end to a handle front (12F), the gouger (14) having a gouger tip (14B) positioned at a front distal end of the member, the gouger tip (14B) having a gouger tip having a gouger tip point (14BA) functioning to prevent attachment of the removed material to the gouger tip (14B), the gouger tip (14B) having a circumference that varies continuously at each adjacent point beginning at the section of said gouger tip notch (14BB) closest to said handle (12) and ending at said gouger tip point (14BA), and the gouger (14) further comprising a gouger first member (14A) securely attached at a rear end to a handle front (12F) and a gouger second member (14C) securely attached at a rear end to a front distal end of the gouger first member (14A), the gouger first member (14A) being configured substantially parallel to a longitudinal axis of the handle (12), the gouger second member (14C) being configured at an obtuse angle to the gouger first member (14A) which functions to facilitate positioning of the gouger tip point (14BA) at or near a crack in the surface.

* * * * *